United States Patent [19]

Coster et al.

[11] Patent Number: 4,659,232

[45] Date of Patent: Apr. 21, 1987

[54] TIMEPIECE

[76] Inventors: Charles S. Coster, 4 Sparks Pl., Cambridge, Mass. 02138; Nicholas Edgington, Box 102, Princeton, Mass. 01541

[21] Appl. No.: 704,495

[22] Filed: Feb. 22, 1985

[51] Int. Cl.[4] ..... G04B 19/00

[52] U.S. Cl. ..... 368/223; 368/228

[58] Field of Search ..... 368/223–238

[56] References Cited

U.S. PATENT DOCUMENTS

| | | | |
|---|---|---|---|
| D. 98,769 | 3/1936 | Horwitt | D10/1 |
| D. 242,694 | 12/1976 | Thompson et al. | D10/1 |
| 2,001,195 | 5/1935 | Horwitt et al. | 58/125 |
| 2,157,540 | 5/1939 | Horwitt | 58/125 |
| 2,243,343 | 5/1941 | Johnson | 368/228 |
| 4,081,953 | 4/1978 | Crutcher | 58/50 |
| 4,206,592 | 6/1980 | Mane | 368/228 |
| 4,428,682 | 1/1984 | Winter | 368/228 |

FOREIGN PATENT DOCUMENTS

| | | | |
|---|---|---|---|
| 43380 | 3/1984 | Japan | 368/282 |
| 155165 | 9/1932 | Switzerland | 368/282 |

*Primary Examiner*—Bernard Roskoski

*Attorney, Agent, or Firm*—Wolf, Greenfield & Sacks

[57] ABSTRACT

A timepiece including a clock face and an hour display. Means are provided for enabling relative movement between the clock face and hour display with the position of display relative to the clock face indicative of increments of an hour. The hour display is incremented on an hourly basis.

16 Claims, 12 Drawing Figures

TIMEPIECE

BACKGROUND OF THE INVENTION

The present invention relates in general to a chronographic device and pertains, more particularly, to an improved chronographic device that has a novel means of displaying time.

A standard clock face for an analog clock has two hands including an hour hand and a minute hand and the clock face is typically segmented into the twelve hour intervals. Other clocks are of purely digital form having a first display indicating hours digitally and an associated second display indicating minutes digitally. Such displays may also include a third display for seconds.

It is an object of the present invention to provide a different form of time display which in essence is a combination of digital and analog display.

Another object of the present invention is to provide a clock that has essentially no hands and in which the face of the clock rotates around a stationary hour indicator, whose axis is located at the periphery of the clock face.

In accordance with another embodiment it is an object to provide a clock in which the face is stationary and the hour display rotates peripherally about the clock face with the relative position thereof indicative of minutes.

Still another object of the present invention is to provide a clock which generally indicates the hour by number and indicates the minutes by the relative position of the hour number relative to the clock face.

Still a further object of the present invention is to provide a clock timepiece in which the hour changes in digital fashion only at each 360° rotation of either the display itself or the clock face.

Another object of the present invention is to provide a clock in which the minute changes continuously in an analog fashion during each 360° rotation of either the clock face or the display.

SUMMARY OF THE INVENTION

To accomplish the foregoing and other objects of the invention, there is provided a timepiece or clock that comprises a clock face and an hour display. Means are provided for causing relative translation between the hour display and the clock face with the position of the display corresponding to increments of an hour. Finally, means are provided for incrementing the hour display each hour. In accordance with one embodiment of the present invention, the hour display is movable about the periphery about the clock face in which case the clock face is fixed in position. The hour display displays the particular hour and the minutes are determined by the position of the display about the circumferential perimeter of the face. In accordance with a second embodiment of the invention described herein the hour display is fixed in position and the face itself rotates essentially about the hour display with once again the position of the hour display relative to the clock face determining the increments of an hour usually in the form of minutes. In both embodiments described herein, upon one hour of rotation either of the clock face or of the display the hour display is incremented to the next hour.

BRIEF DESCRIPTION OF THE DRAWINGS

Numerous other objects features and advantages of the invention should now become apparent upon a reading of the following detailed description taken in conjunction with the accompanying drawings, in which.

DETAILED DESCRIPTION

Reference is now made to FIGS. 1–4 which shows a first embodiment of the present invention. In this connection, reference is also made to FIGS. 5 and 6 which illustrate two other time periods that can be illustrated with this particular embodiment.

Figure 2:
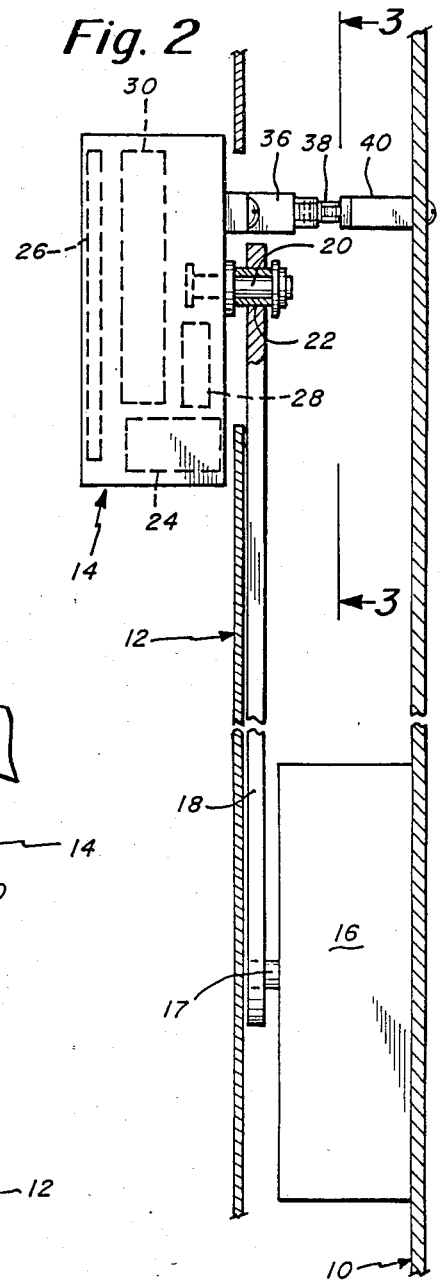
FIG. 2 is a cross-sectional view taken along line 2—2 of FIG. 1.
Figure 3:
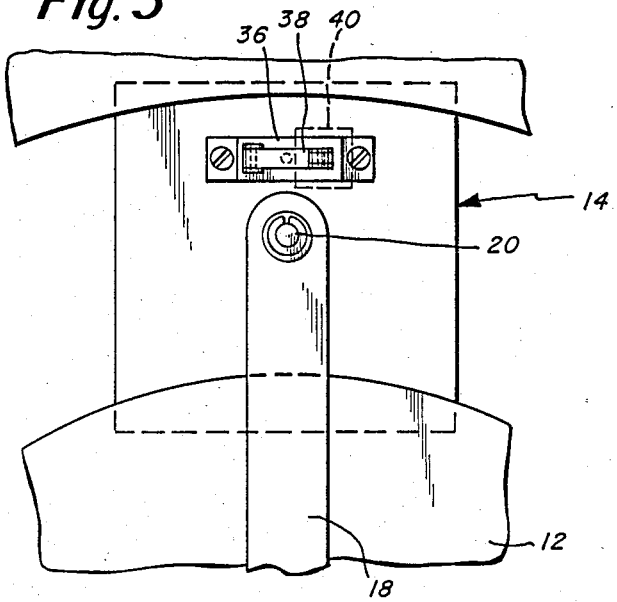
FIG. 3 is a cross-sectional view taken along line 3—3 of FIG. 2.
Figure 4:
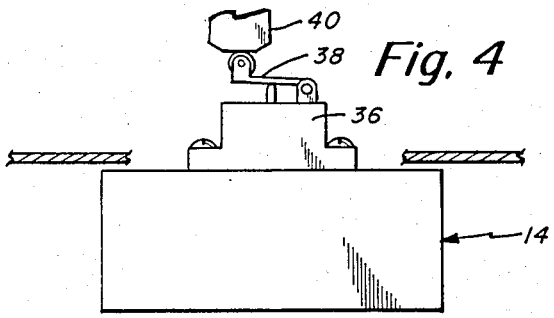
FIG. 4 is a view taken along line 4—4 of FIG. 1.

In the first embodiment there is illustrated a support backer or support plate 10, a face piece 12, and a time cell 14. Behind the face piece 12 there is supported the mechanical timing mechanism 16. The mechanism 16 is secured to the support plate 10 and is of conventional design. The timing mechanism 16 may be of the type used in a clock for supporting the minute hand. The cross-sectional view of FIG. 2 illustrates the timing mechanism 16 having its output shaft 17 coupled to the radial support member 18. Thus, the timing mechanism 16 causes rotation of the radial support member 18 in a clock wise direction and at a rate of 1 full 360° rotation for each hour of time.

The radial support member 18 is disposed behind the face piece 12 and thus for the most part is obstructed by the face piece 12. However, the face piece 12 has a peripheral slot in front of which is mounted the time cell 14. The radial support member 18 is not supported to the face but is adapted to instead rotate behind the fixed face piece 12.

Figure 1:
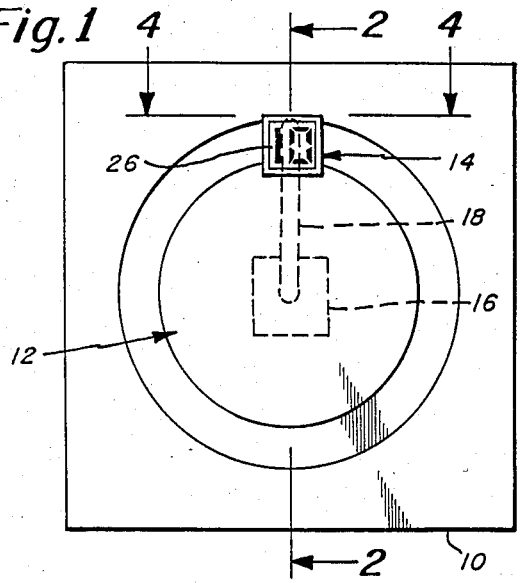
FIG. 1 is a front view of a first embodiment of the timepiece of the present invention.

The time cell 14 is supported from the outer end of the radial support member 18 my means of a pivot arrangement including a pivot pin 20 and a support bearing or bushing 22. With this pivot support the time cell 14 is maintained in an upright readable position as illustrated in FIG. 1. This maintenance in an upright position is also carried out with the use of a weight 24 at the bottom of the time cell. This weight assures that the time cell is always maintained in an upright position such as in the readable position in FIG. 1.

Actually, in FIG. 1 the time that is indicated, assuming that the hour has been reached, is 10:00 o'clock. In connection with FIG. 1 it is also noted that there is shown the timing mechanism 16 and the radial support member 18 coupling to the time cell 14.

As illustrated in FIG. 2 the time cell 14 includes a forwardly directed display 26, the aforementioned weight 24, a battery 28 and electronics 30. The time cell 14 is not shown in detail herein but is illustrated schematically as basically comprising the components illustrated in FIG. 2 inside of the time cell 14. The time cell 14 can be a very standard design and is preferably battery operated as indicated by the battery 28.

The time cell 14 may simply comprise a standard two digit, 8 segment display which is adapted to count from one to twelve and then recount again. The counting of the display is carried out by means of the switch input which causes an increment of one count each time that the switch is actuated. In this regard, refer to FIGS. 2–4 which show the switch 36 mounted to the rear of the time cell 14. The switch 36 has associated therewith an arm 38 that is adapted to be actuated by the trip cam 40 as clearly illustrated in FIG. 4.

The trip cam 40 is secured to the support plate 10 as illustrated in FIG. 2 and extends so as to be engageable with the switch arm 38. In this way, once each 360° of rotation of the radial support member 18 the switch arm 38 comes into contact with the stationary trip cam 40 causing a switch actuation that increments the counter in the electronics 30 so as to thus increment the display to the next hour designation.

Figure 5:
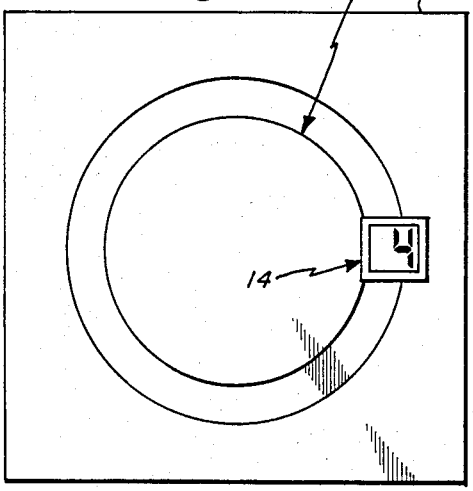
FIG. 5 is a schematic diagram similar to FIG. 1 illustrating one particular time.

In FIG. 1 as indicated previously the time that is indicated is 10:00 o'clock. FIG. 5 schematically illustrates the time some four hours later in which the radial support member 18 has made four full rotations and a quarter rotation so that the cell is at the position illustrated in FIG. 5. The time cell 14 at that particular location indicates a time of 4:15 o'clock. The digital display indicates the hour and the minutes are indicated by virtue of the location of the time cell about the periphery of the face 12. In FIG. 5 the time cell is indicated at a 15 minute position or at 90° to the zero minute position and thus this indicates an overall time of 4:15 o'clock.

Figure 6:
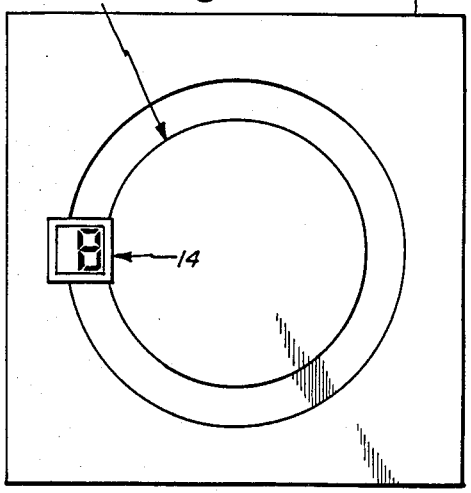
FIG. 6 is a schematic diagram illustrating another time.
Figure 7:
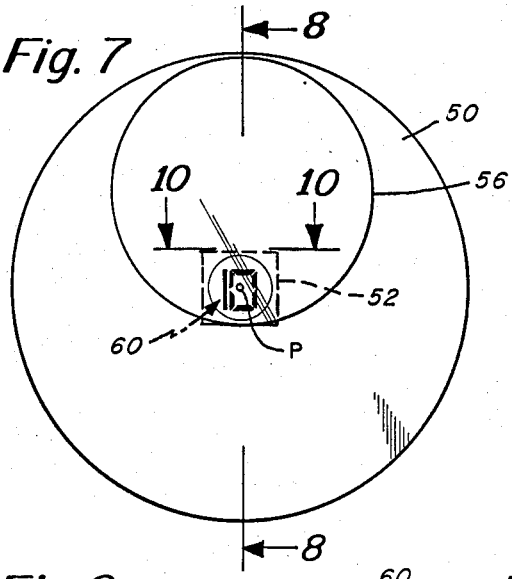
FIG. 7 is a front view of a second embodiment of the present invention.
Figure 8:
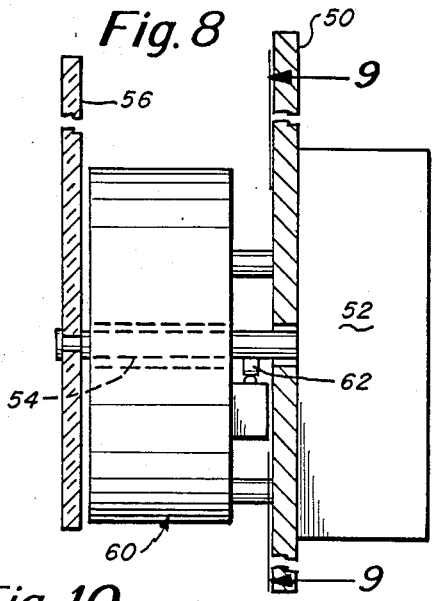
FIG. 8 is a cross-sectional view taken along line 8—8 of FIG. 7 showing further details of this second embodiment.
Figure 9:
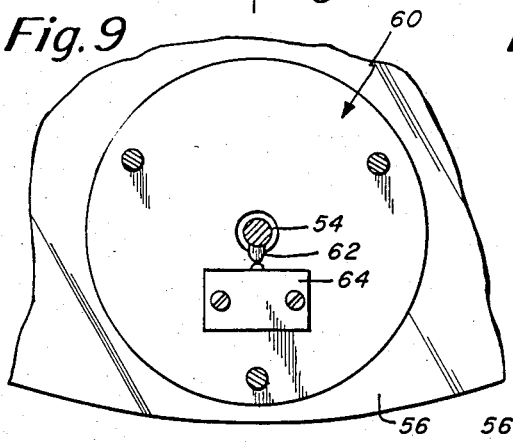
FIG. 9 is a cross-sectional view taken along line 9—9 of FIG. 8.
Figure 10:
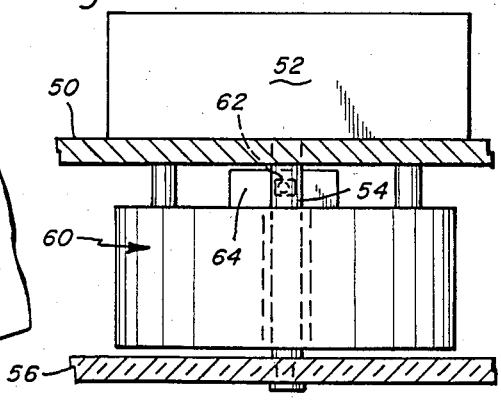
FIG. 10 is a cross-sectional view taken along line 10—10 of FIG. 7.

FIG. 6 schematically illustrates a further time in which there have been a number of additional 360° rotations. As indicated previously, each rotation indexes the display to the next number and in connection with FIG. 6 the display has been incremented to the hour eight. The radial support member 18 has rotated through 270° to a position thus indicating 8:45 o'clock in FIG. 6. Again, the hour display is indicated by the number in the display itself and the minutes are indicated by virtue of the position of the time cell 14 about the circumferential periphery of the face 12.

Figure 11:
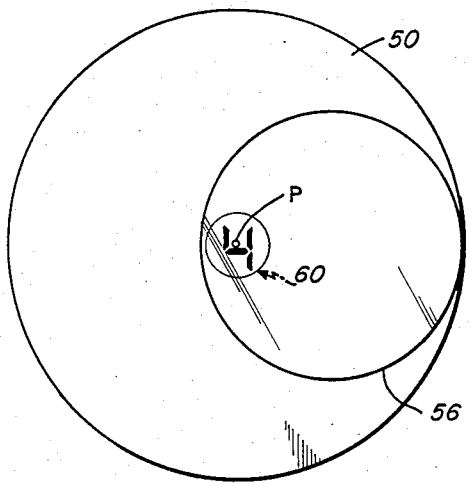
FIG. 11 is a schematic diagram illustrating one particular time with this second embodiment.
Figure 12:
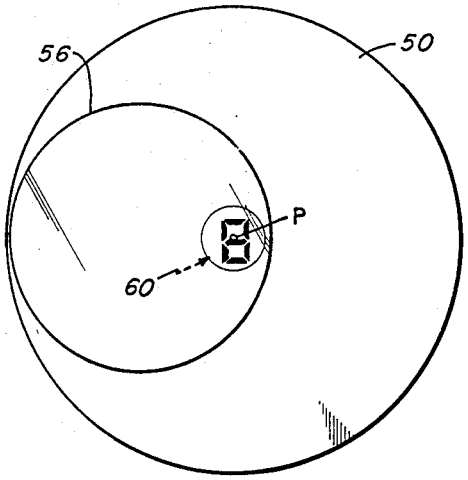
FIG. 12 is a schematic diagram illustrating another time.

FIGS. 7–10 illustrate a second embodiment of the present invention which relates to the first embodiment except that instead of the time cell rotating the time cell is fixed and instead of the face being stationary the face is what rotates essentially in the embodiment of FIGS. 7–10. FIGS. 11 and 12 illustrate two different times.

With regard to the particulars of the second embodiment, there is provided a rear support plate 50. Mounted on this support plate 50 is the timing mechanism 52 which in this embodiment has an elongated shaft 54 having supported at the very end thereof the face piece 56. The face piece 56 is preferably transparent so that the time cell 60 can be viewed therethrough. It is noted that the timing mechanism shaft 54 extends through apertures in the time cell 60 and also the support plate 50.

The time cell 60 may be of identical construction to the time cell 14 illustrated in FIG. 2 as far as the electronics is concerned. The time cell 60 is suitably supported from the support plate 50 and is held in a stationary position as is the support plate 50. The motor 52 is also held stationary but the output shaft 54 attached to the transparent face piece 56 causes rotation of the face piece about a pivot point as illustrated by the point P in FIG. 7. It is noted that the pivot point P is definitely not at the center of the face piece 64 but instead is at a position at the periphery of the face piece.

As with the first embodiment, in the second embodiment means are provided for incrementing the time cell 60. In this regard there is provided directly on the shaft 54 a trip cam 62 which engages a switch 64 secured to the time cell 60. The switch 64 may be of substantially identical construction to the switch and associated actuating arm illustrated in connection with the first embodiment of FIGS. 1–4. The trip cam 62 is located so that once each revolution of the shaft 54 the time cell has its display incremented to the next number. This incrementing occurs at the position when the face has its uppermost location coincident with the time cell (180° to that illustrated in FIG. 7).

FIG. 11 shows another time that is indicated by the arrangement of the second embodiment. In FIG. 11 the face has rotated until the display has indicated 4:00 o'clock and there is an additional 90° of rotation of the face so that the time cell indicating the numeral 4 is at a 90° position as illustrated in FIG. 11. It is noted in FIG. 11 that this thus indicates a time of 4:15 o'clock. It is also noted in FIG. 11 that the support plate is indicated as being stationary and the 4:15 o'clock time is illustrated with the face being rotated so that it extends to the left of the support plate. Of course, the support plate can be made in many different configurations either square or circular or could even be made relatively small so that it is essentially non observably behind the time cell.

FIG. 12 illustrates another time in which the hour has reached 8:00 o'clock but the face has rotated through 270° so that the time indicated is 8:15 o'clock. In this example with the type of support plate that is employed it is noted that the face extends out to the left.

Having now described a limited number of embodiments of the present invention, it should be apparent to those skilled in the art that numerous other embodiments and modifications thereof are contemplated as falling within the scope of the present invention as defined by the appended claims.

What is claimed is:

1. A timepiece comprising;

a clock face defining a peripherally disposed circumferential face display band, a digital hour display for displaying in sequence hours one through twelve one at a time, means for rotating the digital hour display about the circumferential face display band with the position of the display in the clock face band indicative of minutes, and means for incrementing the hour display on an hourly basis.

2. A timepiece as set forth in claim 1 wherein said hour display is a two digit digital display.

3. A timepiece as set forth in claim 2 wherein the means for causing the hour display to move about the periphery of the clock face comprises a timing mechanism and associated radial support member.

4. A timepiece as set forth in claim 3 wherein said means for incrementing the hour display includes switch means responsive to movement of the display actuated to increment the display by one hour for every 360° of rotation of the hour display about the periphery of the clock face.

5. A timepiece as set forth in claim 4 further including a backing plate for supporting a trip cam adapted to actuate the switch and also supporting the timing mechanism.

6. A time piece as set forth in claim 1 wherein said digital hour display includes a two digit display that is disposed only at the periphery of the face.

7. A time piece as set forth in claim 6 wherein the means for rotating includes a radial support member disposed behind the face for supporting the digital hour display at an outer end thereof.

8. A time piece as set forth in claim 7 wherein the radial support member is rotated from the center of the face.

9. A time piece as set forth in claim 8 wherein said means for supporting the digital hour display includes pivot means for enabling the display to remain in an upright viewing position as the display rotates.

10. A time piece as set forth in claim 9 including weight means for maintaining the digital hour display upright.

11. A timing device comprising;

a clock face, an hour display, means for fixing the position of the hour display so that it is stationary, means for causing the clock face to rotate relative to the fixed hour display with the position of the display relative to the clock face indicating increments of an hour, and means for incrementing the hour display upon completion of each rotation of said clock face.

12. A timing device as set forth in claim 11 wherein said hour display is a two digit digital display.

13. A timing device as set forth in claim 12 wherein the pivot point for the face rotation is off of the center axis of the face.

14. A timing device as set forth in claim 13 including means for fixedly securing the hour display.

15. A timing device as set forth in claim 14 including a support plate for supporting on one side thereof a timing mechanism for rotating the face and on the other side thereof said hour display.

16. A timing device as set forth in claim 15 wherein said hour display comprises an electronic two digit digital display adapted to be incremented upon one full rotation of said clock face.

* * * * *